United States Patent [19]

Del Fabro

[11] Patent Number: 5,067,337

[45] Date of Patent: Nov. 26, 1991

[54] DEVICE FOR THE CONTROLLED AND INDEPENDENT ROCKING OF STRAIGHTENING AND BENDING PLATFORMS

[75] Inventor: Giorgio Del Fabro, Montegnacco, Italy

[73] Assignee: M.E.P. Macchine Elettroniche Piegatrici, SpA, Reana Del Rojale, Italy

[21] Appl. No.: 593,757

[22] Filed: Oct. 5, 1990

[30] Foreign Application Priority Data

Oct. 20, 1989 [IT] Italy ..... 83490 A/89

[51] Int. Cl.[5] ..... B21D 3/02; B21D 7/024

[52] U.S. Cl. ..... 72/161; 72/164; 72/307; 72/217

[58] Field of Search ..... 72/160–165, 72/307, 387, 388, 216–219

[56] References Cited

U.S. PATENT DOCUMENTS

| | | | |
|---|---|---|---|
| 2,517,309 | 8/1950 | Heller . | |
| 2,567,770 | 9/1951 | Heller . | |
| 3,052,277 | 9/1962 | Stegmann | 72/307 |
| 4,782,684 | 11/1988 | Benton | 72/307 |

FOREIGN PATENT DOCUMENTS

| | | |
|---|---|---|
| 194478 | 9/1986 | European Pat. Off. . |
| 269157 | 6/1988 | European Pat. Off. . |
| 299857 | 1/1989 | European Pat. Off. . |
| 496227 | 4/1930 | Fed. Rep. of Germany . |
| 1527321 | 10/1969 | Fed. Rep. of Germany . |
| 2723846 | 12/1977 | Fed. Rep. of Germany . |
| 3421410 | 1/1985 | Fed. Rep. of Germany . |
| 2115151 | 7/1972 | France . |
| 2553314 | 10/1984 | France . |

OTHER PUBLICATIONS

International Publication WO83/02076, PCT, Published Jun. 23, 1983, Labbe.

*Primary Examiner*—Daniel C. Crane

*Attorney, Agent, or Firm*—Antonelli, Terry Stout & Kraus

[57] ABSTRACT

Device for the controlled and independent rocking of a bending platform and straightening platform in bending-shaping machines having an independent bending platform (13) located downstream of a straightening platform (11), in which machines the straightening platform (11) has a preferred inclination, whereas the bending platform (13) has an inclination depending on the product being processed at that time, the axis of rotation (17) for adjustment of the inclination of the bending platform (13) being positioned below and at a distance "x" from the axis of the inlet (16) of rods (18) onto the bending platform (13), in which device the straightening platform (11) is supported on a parallelogram system (20) having the axis of lower pivots (26) distant by the value "x" from the axis of upper pivots (25), the axis of the lower pivots (26) coinciding with the axis (17) of rotation of the bending platform (13), whereas the axis of upper pivots (25) is kept so as to coincide substantially with the axis of the inlet (16) of rods (18).

9 Claims, 2 Drawing Sheets

DEVICE FOR THE CONTROLLED AND INDEPENDENT ROCKING OF STRAIGHTENING AND BENDING PLATFORMS

BACKGROUND OF THE INVENTION

This invention concerns a device for controlling and independent rocking of straightening and bending platforms.

To be more exact, the invention is applied to machines that form shaped iron rods for building work and, in particular, shaped stirrup-type rods for the steel reinforcement structures which are sunk in concrete to make reinforced concrete.

The bending-shaping machine according to the invention comprises a straightening assembly upstream of a bending-shaping assembly which is of a type having a disk, central contrast pin and offset beinding pin, for instance.

The bending-shaping machine to which the invention is applied is arranged so that the straightening assembly and bending-shaping assembly lie on independent platforms and the platform of the bending-shaping assembly can be oriented about a lengthwise axis which is substantially parallel to the axis of the passage of the rod to be bent and shaped and is positioned below that latter axis so as to leave the bending platform always free of anything which might obstruct the rod being bent.

The bending platform is that which holds, and on which lies, the bending assemblY and which supports the rod to be bent and shaped during the passage and bending of the rod.

Instead, the straightening platform is that which holds and supports the straightening assembly.

The rod which has to be bent and shaped may have a solid or hollow conformation and may have a smooth surface or have superficial modifications. It cross section may be oval, round, three-lobed, quandrangular, etc.

The rod which has to be bent and shaped will come almost always from a reel, and the straightening assembly will not only have to straighten the rod passing through but will also have to fix the twists which have been imparted to the rod during winding onto and unwinding from a reel.

An example of such straightening is disclosed in the document EP 87202107.6.

It should be borne in mind that rods being unwound from a bundle formed in the hot state on a reel comprise coils which have a difference in length between their inner and outer circumferences.

It is necessary to remember also that such bending-shaping machines can process rods of any size between diameters of 4 and 16 mm. or equivalent diameters.

In normal wound bundles having an average diameter of 1.2 meters a rod with a diameter of 16 mm. has a difference of more than 5 cms. between the lengths of the outer and inner circumferences of a coil.

This difference was not important in the past since the reinforcement rods consisted usually of mild steel of the type FE 33, for instance.

With modern high-strength steels of the type FE 50 and higher, for instance, the problems of the straightening and behaviour of the rods upstream of the straightening assembly have become very important for a successful outcome of the bending and shaping of the rod.

In the bending-shaping machines under discussion, the straightening platform on which the straightening assembly lies is independent of the bending platform on which the bending assembly lies and on which the bending and shaping and subsequently shearing of the rod are carried out.

In machines of this type, and in bending-shaping machines more generally, the adjustment of the rollers of the straightening assembly takes place automatically at the beginning of each wound bundle of rod, and the processing of the rod forming the bundle proceeds by using the same wound bundle as much as possible so as to be able to spread out over the greatest possible number of pieces the downtimes due to preparation of the machine when the type of rod has to be changed.

This means that during the processing of one wound bundle stirrups shaped in different ways and of different sizes or straight rods or bent rods of various types may be produced.

It also means that each type of stirrups or bent rod requires a preferred angular position of the bending platform.

Most of the shaped and bent pieces normally require the bending platform to be inclined in relation to the horizontal by a value between 15° and 45°, advantageously about 30°.

In other words, if the type of straight or bent rod or stirrup to be produced is changed, the machine, within certain values, changes its trim and, in particular, its trim in relation to the horizontal of the bending platform.

As we said above, the bending assembly carries the bending action out as well as possible, in general and particular terms, if it is positioned at a determined angle to the horizontal.

This angle, which varies from 0° (horizontal platform) to 100/150° (inclined platform), depends on a plurality of factors, and the machine manufacturers normally determine it for each type or range of product during design work and then admit a greater or smaller range of angles.

SUMMARY OF THE INVENTION

The present applicant has found that, given a determined profile arriving from a given wound bundle, if the positioning of the bending platform is changed in relation to the horizontal, it is very advantageous that the straightening platform should follow the bending platform so as to keep the inlet of the rod to the bending platform coaxial with the outlet of the rod from the straightening platform.

The present applicant has also found that, if the straightening platform has a preferred positioning in relation to the horizontal and/or in relation to the axis of unwinding of the rod from its reel, it is necessary that this positioning should stay unchanged in relation to the horizontal, irrespective of the positioning taken on by the bending platform.

The present applicant has found by trials that the preferred positioning coincides with the positioning of the straightening platform in a plane parallel to the plane of unwinding of the coils of rod from the wound bundle.

To avoid the problems linked to the depositing of the calamine becoming detached from the rod during the straightening operation, the present applicant has arranged to position the straightening platform with the straightening assembly suspended below it, so that the calamine falls automatically.

According to a variant, with regard to the obstructions which the straightening platform may create for the rod during bending, the present applicant has arranged to position the straightening platform according to a positioning angle which the bending platform takes on in most cases, namely at 25/30° to the horizontal and therefore, in fact, to the p unwinding of the coils of rod.

It was also found during conducted that the positioning to be maintained straightening platform should not create positive negative imparting of auxiliary tensions during the positioning of the bending platform, the purpose being to avoid the application of new adjustments to the straightening assembly, for such adjustments entail wasting of time which is less and less acceptable with the required modern rates of output.

The present applicant has therefore designed, embodied and tested this invention, which overcomes the problems cited above and provides further advantages.

Thus, with a straightening assembly having its inlet and outlet offset in relation to each other, the invention enables a correct reciprocal positioning to be obtained.

The invention also enables the positioning of the bending platform to be modified easily.

The device for the controlled and independent rocking of the bending and straightening platforms respectively is set forth in the main claim, whereas the dependent claims describe variants of the idea of the main solution.

According to the invention the straightening platform is installed on a parallelogram system suitable to keep constant the required trim in relation to the horizontal and/or to the plane of unwinding of the wound bundle of rod, whilst being able to move according to an arc of a circle.

The parallelogram system comprises a frontal arm and a rear arm, both of which possess un upper pivot and a lower pivot.

When the straightening axis is straight, that is to say, when the rod enters and leaves the straightening assembly practically on the same axis, the axis of the upper pivot of the first frontal arm forms the passage of the rod.

Instead, when the straightening axis is offset as between the entry and exit of the rod, for instance as illustrated in FIG. 6 of the cited EP 87202107.6, the upper pivot of the first frontal entry arm will include an offset hole, while the upper pivot of the second frontal exit arm will include a central hole.

According to a variant the axis of rotation of the lower pivot of the first rear arm is connected to a positioning system which, by displacing the position of that axis of rotation, maintains the parallelism of the arms, but the trim of the straightening platform is changed in relation to the horizontal and/or in relation to the plane of unwinding of the wound bundle of rod.

According to the invention the distance between the axis of rotation of the bending platform and the axis of entry of the rod into the bending assembly is equal to the distance between the upper pivot and lower pivot of the arms of the parallelogram system.

Moreover, according to the invention the axis of rotation of the bending platform coincides with the axis of rotation of the lower pivots of the frontal arms of the parallelogram system.

According to the invention the bending platform is equipped with a first unit to control its trim, and this unit controls and acts on the parallelogram system, which supports and positions the straightening platform by means of a second unit to control the trim thereof.

A system to monitor the angular position of the respective pivots cordinates the trim of both platforms.

According to a variant the lower pivot of the frontal arm and the pivot of rotation of the bending platform are substantially the same as each other and, when the preferred trim of the straightening platform has been obtained, the frontal arm and the lateral side of the bending platform are made substantially solidly fixed to each other.

BRIEF DESCRIPTION OF THE DRAWINGS

A possible preferred embodiment of the invention is shown as a non-restrictive example in the attached figures, in which.

DESCRIPTION OF THE PREFERRED EMBODIMENT

Figure 1:
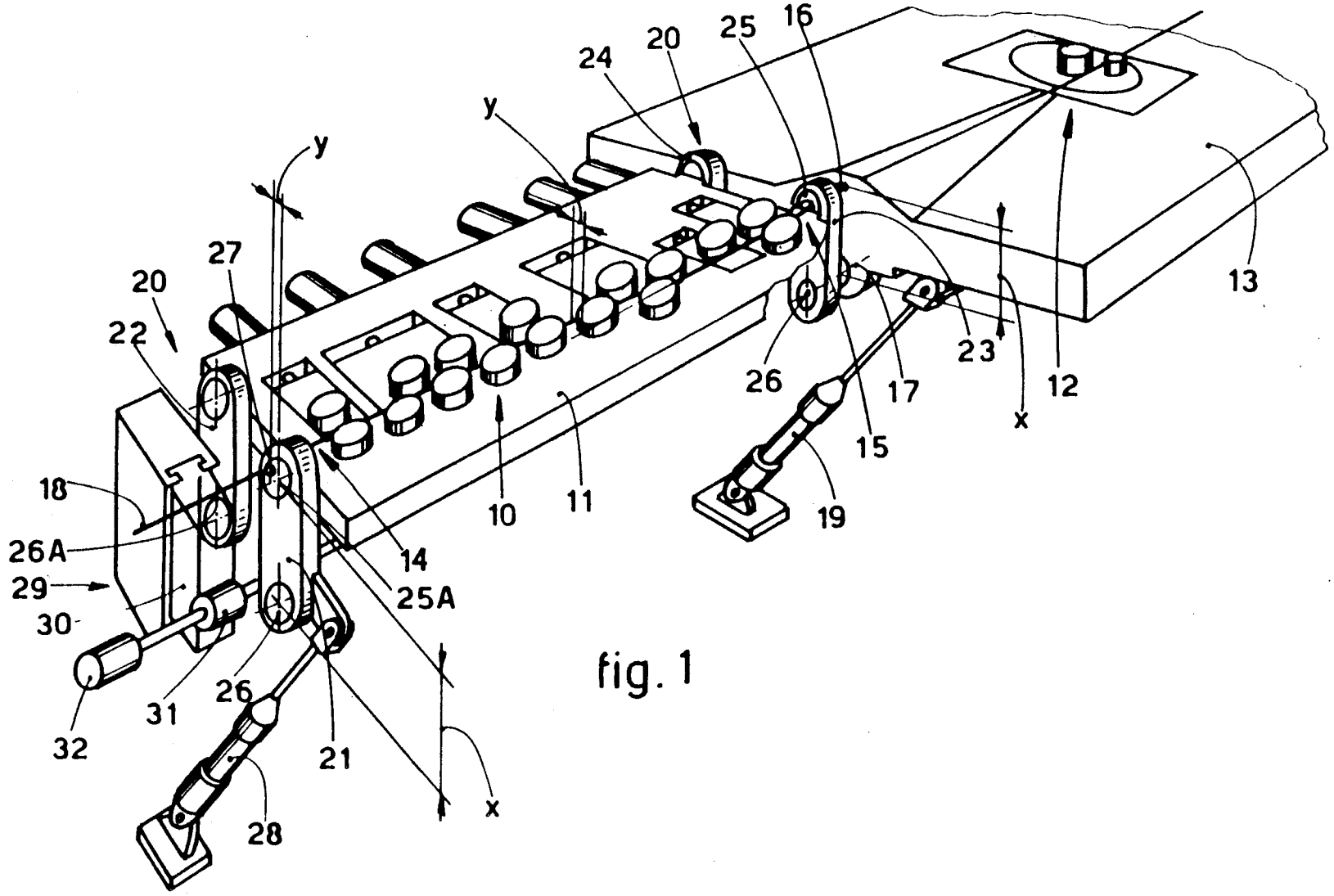
FIG. 1 illustrates the bending-shaping assembly of the present invention with the bending platform in a first position.
Figure 2:
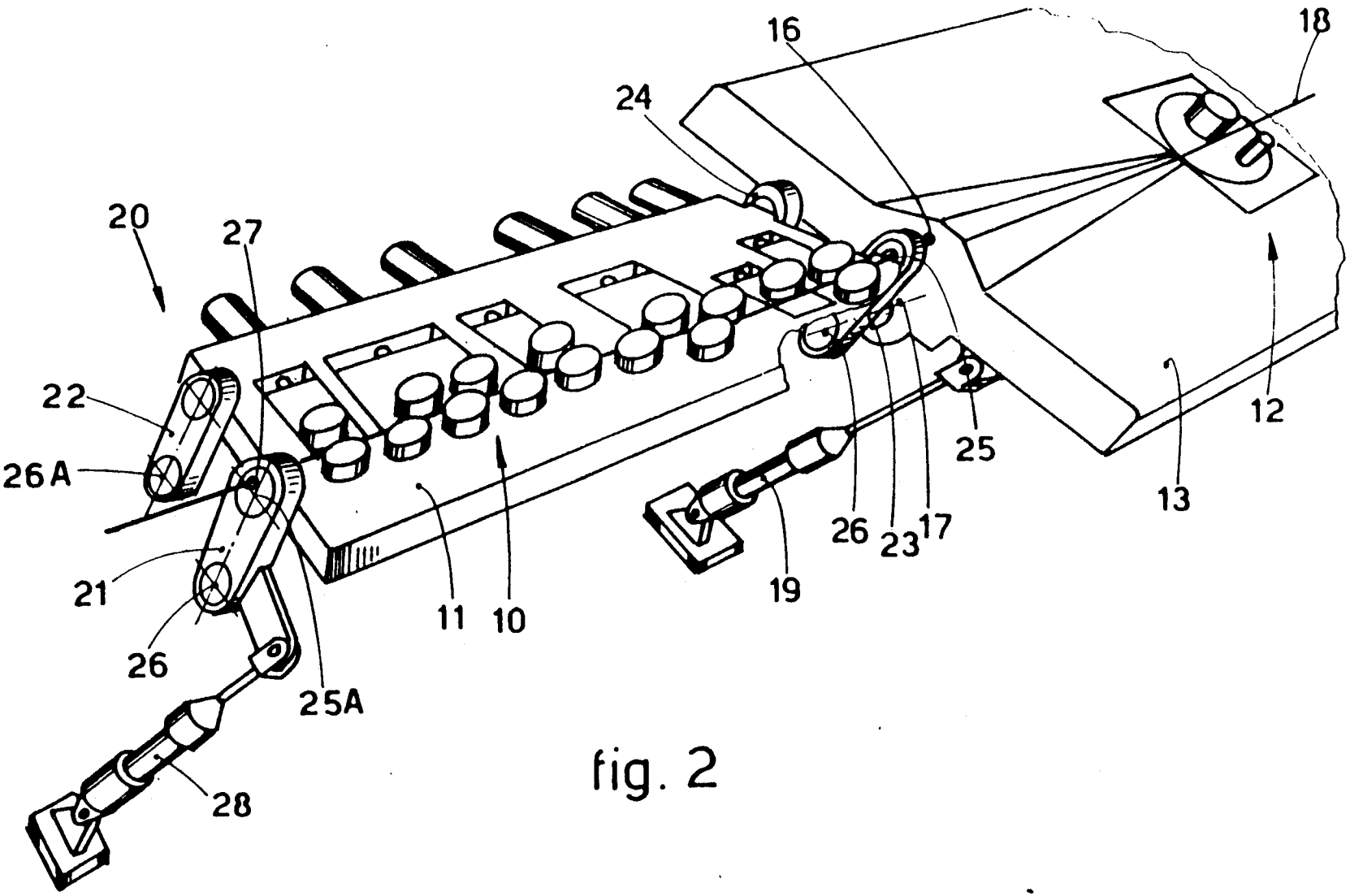
FIG. 2 illustrates the bending-shaping assembly of the present invention with the bending platform in a second position.

In the figures a straightening assembly 10 is located upstream of a bending assembly 12. In the example shown, the straightening assembly 10 is positioned on a straightening platform 11, while the bending assembly 12 is located on a bending platform 13.

In this example the straightening assembly 10 has an inlet 14 offset in relation to its outlet 15 by a value "y".

The bending platform 13 comprises an inlet pipe 16 and can be positioned in relation to the horizontal by being rotated about an axis 17 which is parallel to and below the axis of the passage of rods 18.

The axis of rotation 17 is distant from the axis of the inlet pipe 16 by a value of "x". The rotation of the positioning of the bending platform 13 in relation to the horizontal causes rotation of the rod 18 according to an arc of a circle having a radius "x".

Rotation of the positioning of the bending platform 13 is obtained, for instance, by a first fluid cylinder/piston actuator 19 with a controlled travel and positioning.

The straightening platform 11 is upheld in this example by a parallelogram system 20 comprising two pairs of arms 21–22 and 23–24 respectively. Each arm cooperates with its own upper 25 and lower 26 pivots.

The axis of the lower pivots 26 of the frontal arms 21–23 lies on the axis 17 of rotation of the bending platform 13 and coincides therewith.

According to the invention the distance between the axis of rotation of the upper pivots 25 and the axis of rotation of the lower pivots 26 of the frontal arms 21–23 has a value "x", the same as that of the distance in the bending platform between the axis of the inlet pipe 16 and the axis of rotation 17.

When the required angle of the straightening platform 11 in relation to the horizontal, this being an angle to be defined on a plane normal to the axis of rotation 17, has been fixed by acting on the frontal arms 21 and/or 23 of the parallelogram 20, for instance by means of a second cylinder/piston actuator 28 with a controlled travel and positioning, the axis of the upper pivots 25 is rotated about the axis of rotation 17 according to a radius having a value "x".

If the straightening assembly 10 has its inlet 14 and outlet 15 on the same axis, the inlet 14 and outlet 15 will coincide with the axis of rotation of the upper pivots 25.

Now, if an angular rotation of the bending platform 13 coincides with the angular rotation of the frontal arms 21–23 of the parallelogram 20, the outlet 15 of the straightening assembly 10 will always lie on the axis of the upper pivots 25 of the frontal arms 21–23 and therefore on the axis of the inlet pipe 16 of the bending assembly 12.

If instead, as in the example shown, the inlet 14 of the straightening assembly 10 is offset by a value "y" in relation to the outlet 15 of that assembly, the hole 27 in the upper pivot 25A of the frontal arm 21 upstream of the straightening assembly 10 will be offset in relation to the axis of rotation of the same pivot 25A by a value "y".

According to the invention the lower pivots 26A of the rear arms 22–24 are installed on a unit 29 to adjust inclination of the straightening platform 11.

If the adjustment admitted is the minimum, the adjustment unit 29 may include, for instance, a movable support 30, which can slide in guides and is actuated by a rack and pinion 31 driven by a motor 32.

If the adjustment admitted is considerable, the support 30 will slide in circular guides the generating radius of which is the axis of rotation of the lower pivots 26 of the frontal arms 21–23.

Other alternative systems can be employed, for instance, by having the pivots 26A supported by levers which have their axis of rotation on the axis of the lower pivot 26.

By means of the adjustment system the inclination of the straightening platform 11 too in relation to the horizontal axis can be obtained without the trim of the passage of the rod being modified.

I claim:

1. A bending-shaping machine for shaping rod being fed therethrough, comprising:

a straightening platform having a straightening assembly provided thereon for straightening said rod;

a bending platform having a bending assembly provided thereon, said bending platform being located downstream of said straightening platform and being orientable independently from siad straightening platform said bending assembly performing a different shaping operation on said rod than said straightening assembly;

means for inclining said bending platform by rotating said bending platform about an axis of rotation so as to have a preferred angle of inclination dependent on a shape to be given the rod being processed, said axis of rotation being positioned below and at a distance "x" from an axis of inlet of rod to said bending platform; and a parallelogram system for supporting and positioning said straightening platform, said parallelogram system comprising a pair of frontal arms and a pair of rear arms positioned at four parallel sides of a parallelogram, each of said arms having an upper pivot and a lower pivot, said straightening platform being supported at said upper pivots, a pivot axis of said lower pivots of said frontal arms coinciding with said axis of rotation of said bending platform and being distant by said value "x" from an axis which passes through said upper pivots of said frontal arms and which coincides substantially with said axis of inlet of said rod into said bending platform.

2. A bending-shaping machine according to claim 7, wherein one of said pair of frontal arms is positioned upstream of said straightening assembly and another of said pair of frontal arms is positioned downstream of said straightening assembly, and wherein said upper pivots of said frontal arms are provided with holes through which said rod passes.

3. A bending-shaping machine as claimed in claim 2, in which with the straightening assembly has its inlet and outlet offset from each other by a value "y", the hole for passage of rods in said upper pivot of said frontal arm upstream of said straightening assembly being offset by said value "y" from the axis of rotation of the upper pivot of the frontal arm positioned upstream of the straightening.

4. A bending-shaping machine as claimed in claim 2, in which the lower pivots of the rear arms of the parallelogram system are supported by adjustment means for adjusting the inclination of the straightening platform.

5. A bending-shaping machine as claimed in claim 1, in which the straightening assembly is positioned above the straightening platform.

6. A bending-shaping machine as claimed in claim 1, in which the straightening assembly is positioned below the straightening platform.

7. A bending-shaping machine as claimed in claim 4, in which the adjustment comprises linear slider means for limited adjustments.

8. A bending-shaping machine as claimed in claim 4, in which the adjustment comprises circular slider means with a generator axis placed on the axis of rotation of the lower pivots of the frontal arms.

9. A bending-shaping machine as claimed in claim 4, in which the adjustment means comprises arm means which connect the lower pivots of the frontal arms and rear arms respectively.

* * * * *